US008998264B2

(12) United States Patent
Dorfler et al.

(10) Patent No.: US 8,998,264 B2
(45) Date of Patent: Apr. 7, 2015

(54) IDENTIFICATION DOCUMENT HAVING A PERSONALIZED VISUAL IDENTIFIER AND METHOD FOR PRODUCTION THEREOF

(75) Inventors: Walter Dorfler, Munich (DE); Alfons Assfalg, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 162 days.

(21) Appl. No.: 13/387,437

(22) PCT Filed: Jul. 27, 2010

(86) PCT No.: PCT/EP2010/004571

§ 371 (c)(1),
(2), (4) Date: Jan. 27, 2012

(87) PCT Pub. No.: WO2011/012281

PCT Pub. Date: Feb. 3, 2011

(65) Prior Publication Data

US 2012/0126525 A1 May 24, 2012

(30) Foreign Application Priority Data

Jul. 31, 2009 (DE) ..... 10 2009 035 413

(51) Int. Cl.
*B42D 25/309* (2014.01)
*B42D 25/435* (2014.01)
(Continued)

(52) U.S. Cl.
CPC ..... *B42D 25/41* (2013.01); *B42D 25/00* (2014.01); *B42D 2035/44* (2013.01); *B42D 2035/50* (2013.01); *B41M 3/14* (2013.01); *B41M 5/26* (2013.01)

(58) Field of Classification Search
USPC ..... 283/72, 77, 86
See application file for complete search history.

(56) References Cited

U.S. PATENT DOCUMENTS 4,579,754 A 4/1986 Maurer et al.
7,667,894 B2 2/2010 Hoffmuller (Continued)

FOREIGN PATENT DOCUMENTS

DE 3151407 C1 10/1983
EP 1935664 A1 6/2008

(Continued)

OTHER PUBLICATIONS

U.S. Appl. No. 61/053,756 of 2011/0037247 (May 16, 2008).*

(Continued)

*Primary Examiner* — Kyle Grabowski
(74) *Attorney, Agent, or Firm* — Lathrop & Gage LLP

(57) ABSTRACT

An identification document (10) comprises a personalized first visual marking (14) that is arranged in a first region (12) of the identification document (10), the first region (12) being configured in such a way that, upon laser irradiation of the same, local darkenings of the optical impression of the identification document (10) are produced, resulting from material transformations. The identification document (10) further exhibits a second visual marking (26) that produces the optical impression of a copy of the first visual marking (14) and is arranged in a second region (22) of the identification document (10), the second region (22) being configured in such a way that, upon laser irradiation of the same, local lightenings of the optical impression of the identification document (10) are produced, resulting from material transformations.

17 Claims, 1 Drawing Sheet

Figure 1:
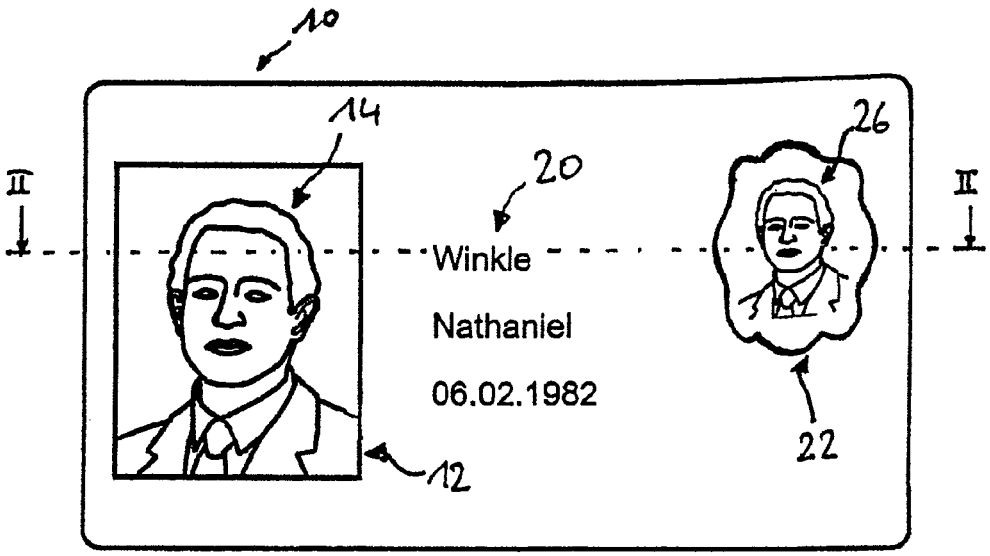

(51) Int. Cl.

| | |
|---|---|
| ***B42D 25/41*** | (2014.01) |
| ***B42D 25/00*** | (2014.01) |
| *B41M 3/14* | (2006.01) |
| *B41M 5/26* | (2006.01) |

(56) References Cited

U.S. PATENT DOCUMENTS

| | | | | |
|---|---|---|---|---|
| 7,728,931 | B2 | 6/2010 | Hoffmuller | |
| 7,808,605 | B2 | 10/2010 | Hoffmuller | |
| 7,986,459 | B2 | 7/2011 | Kaule | |
| 8,083,894 | B2 | 12/2011 | Gruszczynski | |
| 8,149,511 | B2 | 4/2012 | Kaule | |
| 2003/0161017 | A1* | 8/2003 | Hudson et al. | 359/2 |
| 2007/0165182 | A1 | 7/2007 | Hoffmuller | |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0191462 | A1* | 8/2008 | Depta et al. | 283/110 |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |
| 2009/0001709 | A1 | 1/2009 | Kretschmar | |
| 2009/0008923 | A1 | 1/2009 | Kaule | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0236061 | A1 | 9/2009 | Gruszczynski | |
| 2009/0297805 | A1 | 12/2009 | Dichtl | |
| 2009/0322071 | A1 | 12/2009 | Dichtl | |
| 2010/0007130 | A1* | 1/2010 | Komarek | 283/72 |
| 2010/0175843 | A1 | 7/2010 | Gregarek | |
| 2010/0177094 | A1 | 7/2010 | Kaule | |
| 2010/0182221 | A1 | 7/2010 | Kaule | |
| 2010/0194091 | A1 | 8/2010 | Heim | |
| 2010/0194532 | A1 | 8/2010 | Kaule | |
| 2010/0196587 | A1 | 8/2010 | Keller | |
| 2010/0207376 | A1 | 8/2010 | Heim | |
| 2010/0208036 | A1 | 8/2010 | Kaule | |
| 2010/0307705 | A1 | 12/2010 | Rahm | |
| 2010/0308570 | A1 | 12/2010 | Heim | |
| 2010/0320742 | A1 | 12/2010 | Hoffmuller | |
| 2011/0007374 | A1 | 1/2011 | Heim | |
| 2011/0012337 | A1 | 1/2011 | Heim | |
| 2011/0027538 | A1 | 2/2011 | Hoffmann | |
| 2011/0037247 | A1* | 2/2011 | Tappij-Gielen | 283/77 |
| 2011/0045248 | A1 | 2/2011 | Hoffmuller | |
| 2011/0069360 | A1 | 3/2011 | Dichtl | |
| 2011/0079997 | A1 | 4/2011 | Heim | |
| 2011/0091665 | A1 | 4/2011 | Heim | |
| 2011/0095518 | A1 | 4/2011 | Hoffmuller | |
| 2011/0101670 | A1 | 5/2011 | Heim | |
| 2011/0109078 | A1 | 5/2011 | Hoffmuller | |
| 2011/0114733 | A1 | 5/2011 | Heim | |
| 2011/0131737 | A1* | 6/2011 | Uyttendaele et al. | 283/72 |
| 2011/0157183 | A1 | 6/2011 | Kaule | |
| 2012/0126525 | A1 | 5/2012 | Dorfler | |
| 2012/0168515 | A1 | 7/2012 | Schutzmann | |
| 2012/0170124 | A1 | 7/2012 | Fuhse | |

FOREIGN PATENT DOCUMENTS

| | | | |
|---|---|---|---|
| WO | WO 2005/062978 | A2 | 7/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007076952 | | 7/2007 |
| WO | WO 2007079851 | | 7/2007 |
| WO | WO 2007115648 | | 10/2007 |
| WO | WO 2008/000350 | | 1/2008 |
| WO | WO 2008/000351 | | 1/2008 |
| WO | WO 2008/049533 | | 5/2008 |
| WO | WO 2008/061636 | | 5/2008 |
| WO | WO 2008/071325 | | 6/2008 |
| WO | WO 2008/084315 | A2 | 7/2008 |
| WO | WO2008084315 | * | 7/2008 |
| WO | WO 2009/000527 | | 12/2008 |
| WO | WO 2009/000528 | | 12/2008 |
| WO | WO 2009/000529 | | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |
| WO | WO 2009/149831 | | 12/2009 |
| WO | WO 2009/149833 | | 12/2009 |
| WO | WO 2009/156079 | | 12/2009 |
| WO | WO 2010/000470 | | 1/2010 |
| WO | WO 2010/003646 | | 1/2010 |
| WO | WO 2010/028739 | | 3/2010 |
| WO | WO 2011/012281 | | 2/2011 |
| WO | WO 2011/032665 | | 3/2011 |
| WO | WO 2011/032671 | | 3/2011 |

OTHER PUBLICATIONS

International Search Report, International Application No. PCT/EP2010/004571, 2 pages, May 31, 2011.

International Preliminary Report on Patentability, International Application No. PCT/EP2010/004571, 6 pages, Feb. 7, 2012, English Translation.

* cited by examiner

IDENTIFICATION DOCUMENT HAVING A PERSONALIZED VISUAL IDENTIFIER AND METHOD FOR PRODUCTION THEREOF

CROSS-REFERENCE TO RELATED APPLICATIONS

This application is the U.S. National Stage of International Application No. PCT/EP2010/004571, filed Jul. 27, 2010, which claims the benefit of German Patent Application DE 10 2009 035 413.1, filed Jul. 31, 2009, both of which are hereby incorporated by reference to the extent not inconsistent with the disclosure herewith.

The present invention relates to an identification document having a personalized first visual marking that is arranged in a first region of the identification document, the first region being configured in such a way that, upon laser irradiation of the same, local darkenings of the optical impression of the identification document are produced, resulting from material transformations. Further, the present invention relates to a manufacturing method for an identification document.

Identification documents, such as identification cards, credit cards, bank cards, insurance cards, membership cards, access cards, electronic wallets and the like, are increasingly being used in different service sectors, as well as within companies. Normally, they must fulfill two opposing conditions. On one hand, due to their wide circulation, they constitute a mass-produced product that should be easy and economical to manufacture. On the other hand, due to their legitimization function, they are intended to offer the greatest possible security against counterfeiting or forgery. The multitude of kinds of identification cards available bears witness to the numerous efforts and the diverse proposals on how these opposing requirements can be suitably combined.

From German patent specification DE 31 51 407 C1, for example, a multilayer identification card is known that is furnished with a plastic foil as a recording medium. The plastic foil appears completely intransparent in the visible wavelength range, but absorbs so strongly at the wavelength of an infrared laser used for inscribing information that a local blackening of the foil results from the action of the laser radiation. With this, images and/or data can be inscribed in the plastic foil with good resolution.

However, such laser-engraved images are not safe from subsequent adding of additional information. It is thus possible, for example, to subsequently blacken regions of the image by means of a laser beam. In this way, a portrait photo can be altered considerably, for example by adding additional hair, a beard or glasses. Various security measures are taken to prevent such counterfeiting in identification documents. Examples include adding holograms, or micro-letters hidden in images or text.

However, these measures are relatively complex and can often be reliably identified only with technical devices.

Proceeding from this, it is the object of the present invention to provide an identification document that is difficult to counterfeit and whose authenticity is verifiable, particularly without great effort, and a method for manufacturing such an identification document.

This object is solved by the identification document and the manufacturing method having the features of the independent claims. Developments of the present invention are the subject of the dependent claims.

According to the present invention, a generic identification document exhibits a second visual marking that produces the optical impression of a copy of the first visual marking. The second visual marking is arranged in a second region of the identification document. The second region is configured in such a way that, upon laser irradiation of the same, local lightenings of the optical impression of the identification document are produced, resulting from material transformations.

In other words, the identification document comprises two regions, there being able to be produced by laser irradiation, in the one region, local darkenings of the optical impression, and in the other region, local lightenings. Both regions exhibit visual markings, such as a portrait photo of the owner of the identification document, the visual marking in the second region producing the optical impression of a copy of the visual marking in the first region. This means, in particular, that the second visual marking produces the impression of a positive image of the first visual marking, that is, dark regions in the first visual marking correspond to dark regions in the second visual marking and light regions correspond to light regions. The color impression and the size of the second visual marking can, but need not, completely match the color impression and the size of the first visual marking. Rather, the scale of the second visual marking can be diminished or also enlarged with respect to the first visual marking. Also the color impression of the second marking can differ from the color impression of the first marking and range, for example, instead of from white (light) to black (dark), from silver (light) to blue (dark).

Further, the first and/or particularly the second visual marking can be formed by an optically variable color whose color impression for the viewer changes with the viewing angle (color-shift effect). In that case, the color-shift effect is superimposed on a lighter or darker color impression of the fractional regions of the visual marking.

However, due to the fact that the respective regions containing the two visual markings, as described above, react oppositely to laser radiation, specifically once through an optical impression that becomes darker and once through an optical impression that becomes lighter, it is difficult or nearly impossible for a potential counterfeiter to manipulate both visual markings in such a way that the matching optical impression is preserved. If, for example, an additional line is produced in the first visual marking by means of a laser beam, it will appear dark. If, however, the second visual marking is processed accordingly by means of a laser beam, it is possible to produce merely a lightening in an already dark background. A similar production of a dark line for manipulating the first visual marking, in contrast, is not possible.

Since the second visual marking produces the optical impression of a copy of the first visual marking, the authenticity of the identification document can be verified by simply comparing the two markings with the naked eye. Deviations between the markings are easily perceptible for the viewer. In this way, any manipulation of the identification document can be easily perceived, also by a layperson, by comparing the two visual markings without using auxiliary means. Special technical devices are not necessary for the authenticity check.

In an advantageous embodiment of the present invention, the first visual marking constitutes a two-dimensional image. In particular, the first visual marking is a portrait photo of the owner of the identification document. Alternatively or additionally, the visual marking can also exhibit personal data of the owner in the form of letters and/or numbers.

In a further embodiment, the second region is configured in such a way that the lightenings produced in the second region upon laser irradiation are effected due to local color transformations in the identification document from a dark color to a light color. This can be, for example, a color transformation from blue to silver. For this, the second region advantageously exhibits an optically variable ink, that is, an ink having special pigments whose color changes upon the action of laser radiation. The optically variable ink is preferably on an inner layer of the identification document in the second region. Besides optically variable inks, also other colors or inks in which laser irradiation results in a color transformation can be used.

Further, it is advantageous when the first region exhibits a material in which the effect of laser radiation induces a blackening. This can be a plastic material, such as polycarbonate or polyvinyl chloride, in which absorber particles are contained that react upon laser irradiation and thus cause a blackening, as known from laser engraving.

According to a further embodiment, the first visual marking is visible due to local darkenings of the optical impression of the identification document, effected by a first laser beam and resulting from material transformations, and the second visual marking is visible due to local lightenings of the optical impression of the identification document, effected by a second laser beam and resulting from material transformations.

Further, it is advantageous when the identification document comprises, applied to a carrier element of the identification document, a self-supporting transfer element, such as a patch or a label, and the transfer element includes the second visual marking. It is advantageous to provide the second visual marking in the interior of the patch so that it is protected against external influences. Such a transfer element is typically applied to the identification document only after its manufacture.

It is also possible to laminate the patch into the identification document. For this, the identification document in the unfinished state is provided with the patch and, thereafter, for protection, additional, fully or partially transparent foils are joined with the identification document in a lamination process. The second visual marking can be arranged on the surface of the patch or on an inner layer.

According to a further embodiment, the identification document exhibits the form of a card. Examples of such card-form identification documents include identification cards, credit cards, bank cards, insurance cards, membership cards, access cards and electronic wallets. Alternatively, however, the identification document can also be designed to not be in card form, for example as a data page in a passport.

According to one embodiment of the present invention, the identification document is made up of multiple layers. The individual layers are joined through a lamination method or another suitable method.

Further, according to the present invention, a method for manufacturing an identification document is provided in which the identification document is irradiated by means of a first laser beam in such a way that material transformations are effected that induce local darkenings of the optical impression of the identification document, the local darkenings of the optical impression of the identification document making a personalized first visual marking on the identification document visible. Further, the identification document is irradiated by means of a second laser beam in such a way that material transformations are effected that induce local lightenings of the optical impression of the identification document, the local lightenings of the optical impression of the identification document making visible on the identification document a second visual marking that produces the optical impression of a copy of the first visual marking. By means of this method, it is possible to manufacture the above-described identification document according to the present invention.

The second laser beam can exhibit the same properties, particularly the same wavelength, as the first laser beam, and can thus be the same laser beam. Alternatively, the second laser beam can also differ from the first laser beam, particularly with respect to its wavelength.

According to one embodiment of the method according to the present invention, upon irradiation of the identification element by means of the first laser beam, a first two-dimensional radiation pattern is produced, cumulatively, through the irradiation time or the irradiation intensity, in a first region of the identification element, and upon irradiation of the identification element by means of the second laser beam is produced, likewise cumulatively, through the irradiation time/irradiation intensity, in a second region of the identification element, a second two-dimensional radiation pattern that is inverted with respect to the first radiation pattern. That is, points or areal sections in the second region that correspond to points or areal sections in the first region that were irradiated with high laser intensity are irradiated with low laser intensity or not at all. Accordingly, points or areal sections in the second region that correspond to points or areal sections in the first region that were not irradiated, or were irradiated merely with low laser intensity, are irradiated with high laser intensity.

The second radiation pattern can be diminished or enlarged with respect to the first radiation pattern. The visual markings resulting from the irradiation are accordingly enlarged or diminished with respect to each other.

According to one embodiment, upon irradiation of the identification document by means of the first laser beam, local blackenings are effected in a first region of the identification document. Advantageously, upon irradiation of the identification document by means of the second laser beam, local color transformations are effected in a second region of the identification document, from a dark color to a light color, particularly from blue to silver.

Further, it is advantageous when, upon irradiation of the identification document by means of the second laser beam, a transfer element, such as a patch or a label, is irradiated to effect the material transformations that make the second visual marking visible, and after the irradiation, the transfer element is applied to a carrier element of the identification document.

Further exemplary embodiments and advantages of the present invention are explained below by reference to the attached schematic drawings, in which a depiction to scale and proportion was dispensed with in order to improve clarity.

Figure 2:
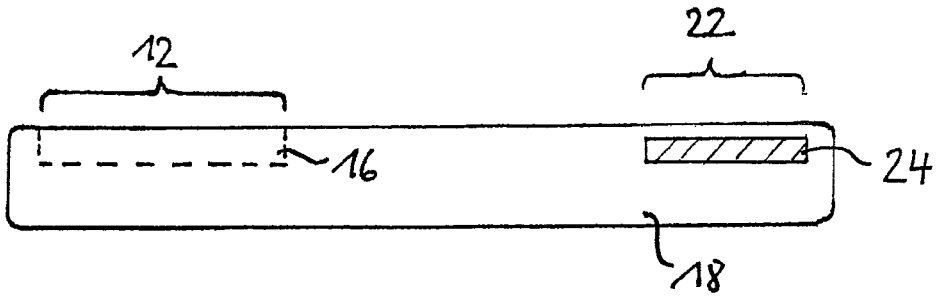

Shown are:

FIG. 1 a top view of an identification document according to an exemplary embodiment of the present invention, diagrammed schematically, and FIG. 2 a sectional view of the identification document in FIG. 1 along the line II-II.

The present invention will now be explained using the example of an identification document that is depicted schematically in FIGS. 1 and 2. FIG. 1 shows the identification document in the form of an identification card 10, for example in the form of a personal identity card or a driver's license card, in top view. However, the present invention is not limited to such identification cards, but rather, the identification document can also be developed in arbitrary formats, for example as the personalized data page of a passport.

The identification card 10 includes, in a first region 12, a personalized first visual marking 14 in the form of a portrait photo of the card owner. Next to the portrait photo are arranged further personal data 20, in the exemplary embodiment the first name, last name and birth date of the owner. Furthermore, the identification card can include further data, such as nationality, issuing authority, issue date and the like.

Furthermore, the identification card 10 comprises a second region 22 having a second visual marking 26. The second region 22 is formed by a transfer element 24 in the form of a patch or label, particularly in the form of a so-called "STEP® sign print", which constitutes a patch that is printed on with a special optically variable ink (OVI®), as described below. As evident from the cross-sectional diagram in FIG. 2, the transfer element 24 is applied on an inner layer of a main body 18 of the identification card 10. The second visual marking 26 displays the portrait photo of the card owner from the first region 12 in a diminished depiction. More precisely, the second visual marking 26 produces the optical impression of a diminished copy of the portrait photo that forms the first visual marking 14. Alternatively, the second visual marking 26 can also render the portrait photo in the same scale as the first visual marking 14, or also in an enlarged scale.

In the first region 12, the identification card 10 includes, in the region of the surface of the main body 18, a laser-sensitive recording layer 16. The recording layer 16 can be a fractional region of the main body 18, and particularly as illustrated in FIG. 2 by way of example, a near-surface fractional region that extends merely in the first region 12. But the recording layer 16 can also be a separate layer of the main body 18. Furthermore, also the entire main body 18 can form the laser-sensitive recording layer 16. The main body 16 of the identification card 10 can be produced from a plastic material, such as polycarbonate (PC) or polyvinyl chloride (PVC). Further, the main body can exhibit a layer structure. Typically, absorber particles are included in the plastic material in the laser-sensitive recording layer 16. The absorber particles are blackened upon irradiation with a laser beam.

In this way, it is possible to produce, through suitable laser irradiation, the portrait photo of the card owner as a black-and-white image in the recording layer 16. A pulsed infrared laser is particularly suitable for this. The method for producing the portrait photo is also known as laser engraving. Expressed in general terms, the portrait photo is produced in the first region 12 by such irradiation of the recording layer 16 that material transformations are effected that induce local darkenings of the optical impression of the recording layer 16.

The transfer element 24 includes an optically variable ink that not only displays a common color-shift effect, but that is also laser engravable, the initial intrinsic blue color changing to a more or less silver color impression upon the action of laser radiation. With increasing intensity of the laser radiation, an increasing proportion of the original blue (darker) color disappears and the proportion of the silver (lighter) color increases.

The present invention is, of course, not limited to inks having a transition from blue to silver. In the general case, an ink provided with suitable pigments changes from a dark color to a light color upon laser irradiation. In this way, it is possible to produce, through laser irradiation of the transfer element 24, local lightenings of the optical impression, resulting from material transformations. The portrait photo that forms the second visual marking 26 is produced through appropriate laser irradiation. The wavelength of the laser light used for this can be identical to the laser wavelength used to produce the first visual marking 14, and can be, for example, in the infrared range. However, other wavelengths can also be used.

As already mentioned above, the second visual marking 26 is intended to exhibit the optical impression of a copy of the first visual marking 14. Due to the inverse reaction of the optically variable ink in the second region 22 formed by the transfer element 24 to laser radiation compared with the reaction of the recording layer 16 in the first region 12, the radiation distribution of the laser radiation upon writing to the second region 22 is configured to be inverse to the radiation distribution upon writing to the first region 12. While, in the first visual marking 14, dark image areas are produced with high laser energy and light image areas with low laser energy, in the second visual marking 26, light, in the exemplary embodiment silver, image areas are produced with high laser energy and dark, in the exemplary embodiment blue, image areas with low laser energy.

In other words, a negative image having a positive impression is written to the second region 22. The portrait photos in the two regions 12 and 22 are thus each positive images as regards their impression, and are thus easily comparable for verifying the authenticity of the identification card 10. If a counterfeiter attempts to subsequently manipulate the portrait photos through laser irradiation, he will find that the laser beam produces dark lines in the portrait photo of the first region 12, and in contrast, light lines in the portrait photo of the second region 22.

A consistent subsequent manipulation of both portrait photos, for example, the addition of a beard or the changing of the hair color, is thus made extraordinarily difficult or even impossible. In any case, such a subsequent manipulation is easily perceptible without using auxiliary optical means.

Furthermore, it is conceivable to include also the personal data 20 in each of the two regions 12 and 22. This makes also a manipulation of this data difficult, since added blackenings in the first region 12, such as in the form of a line element to transform the number "3" into the number "8", would not be reproducible, or only with difficulty, in the second region 22.

It is understood that the identification card 10 can exhibit additional layers, for example one or more protective layers, or functional layers provided with other security elements. These further layers are neither shown in the figures nor described in greater detail.

We claim:

1. An identification document comprising a first visual marking and a second visual marking, wherein the first visual marking comprises a personalized first visual marking that is arranged in a first region of the identification document and that constitutes a two-dimensional image, the first region being configured in such a way that, upon laser irradiation of the same, local darkenings of the optical impression of the identification document are produced, resulting from material transformations, wherein the identification document further exhibits a second visual marking that produces the optical impression of a copy of the first visual marking, wherein the copy is a positive image of the first visual marking, wherein dark regions and light regions in the first visual marking correspond respectively to dark regions and light regions in the second visual marking, and wherein the second visual marking is arranged in a second region of the identification document, wherein the second region comprises an ink whose color changes upon the action of laser radiation, the second region being configured in such a way that, upon laser irradiation of the same, local lightenings of the optical impression of the identification document from a dark color to a light color are produced, resulting from material transformations of the ink.

2. The identification document according to claim 1, characterized in that the ink is an optically variable ink.

3. The identification document according to claim 1, characterized in that the first region exhibits a material in which the action of laser radiation induces a blackening.

4. The identification document according to claim 1, characterized in that the first visual marking is visible due to local darkenings of the optical impression of the identification document, effected by a first laser beam and resulting from material transformations, and the second visual marking is visible due to local lightenings of the optical impression of the identification document, effected by a second laser beam and resulting from material transformations.

5. The identification document according to claim 1, characterized in that the identification document comprises, applied to a main body of the identification document, a self-supporting transfer element, and the transfer element includes the second visual marking.

6. The identification document according to claim 5, wherein the self-supporting transfer element comprises a patch or a label.

7. The identification document according to claim 1, characterized in that the second visual marking is diminished or enlarged with respect to the first visual marking.

8. The identification document according to claim 1, characterized in that the identification document exhibits the form of a card.

9. The identification document according to claim 1, characterized in that the identification document exhibits a layer structure.

10. A method for manufacturing an identification document comprising a first visual marking and a second visual marking, comprising the steps in which:

by means of a first laser beam, the identification document is irradiated in such a way that material transformations are effected that induce local darkenings of the optical impression of the identification document, the local darkenings of the optical impression of the identification document making the first visual marking of a personalized first visual marking on the identification document visible, and by means of a second laser beam, the identification document is irradiated in such a way that material transformations are effected that induce local lightenings of the optical impression of the identification document, the local lightenings of the optical impression of the identification document making visible on the identification document a second visual marking that produces the optical impression of a copy of the first visual marking, wherein the copy is a positive image of the first visual marking;

wherein the second visual marking is arranged in a second region of the identification document, wherein the second region comprises an ink whose color changes upon the action of laser radiation, and whereupon irradiation of the identification document by means of the second laser beam, local color transformations from a dark color to a light color are effected in the ink.

11. The method according to claim 10, characterized in that, upon irradiation of the identification document by means of the first laser beam, a first two-dimensional radiation pattern is produced, cumulatively, through the irradiation time, in a first region of the identification document, and upon irradiation of the identification document by means of the second laser beam, a second two-dimensional radiation pattern that is inverted with respect to the first radiation pattern is produced, likewise cumulatively, through the irradiation time, in a second region of the identification document.

12. The method according to claim 11, characterized in that the second radiation pattern is diminished or enlarged with respect to the first radiation pattern.

13. The method according to claim 10, characterized in that, upon irradiation of the identification document by means of the first laser beam, local blackenings are effected in a first region of the identification document.

14. The method according to claim 10, characterized in that, upon irradiation of the identification document by means of the second laser beam, a transfer element is irradiated to effect the material transformations that make the second visual marking visible, and after the irradiation, the transfer element is applied on a main body of the identification document.

15. The method according to claim 14, wherein the transfer element comprises a patch or a label.

16. The method according to claim 10, characterized in that the manufactured identification document comprises the personalized first visual marking that is arranged in a first region of the identification document, the first region being configured in such a way that, upon laser irradiation of the same, local darkenings of the optical impression of the identification document are produced, resulting from material transformations; and the second visual marking that produces the optical impression of the copy of the first visual marking, wherein the second visual marking is arranged in a second region of the identification document, the second region being configured in such a way that, upon laser irradiation of the same, local lightenings of the optical impression of the identification document are produced, resulting from material transformations.

17. The method according to claim 10, wherein the ink is an optically variable ink.

* * * * *